US008209948B2

(12) United States Patent
Takahashi et al.

(10) Patent No.: US 8,209,948 B2
(45) Date of Patent: Jul. 3, 2012

(54) MULTILAYER STRUCTURED SPUN YARN, PROCESS FOR PRODUCING THE SAME, AND, FABRICATED FROM THE YARN, HEAT-RESISTANT FABRIC AND HEAT-RESISTANT PROTECTIVE SUIT

(75) Inventors: Masanobu Takahashi, Osaka (JP); Keita Tasaki, Osaka (JP); Yukimasa Tanimoto, Osaka (JP)

(73) Assignees: The Japan Wool Textile Co., Ltd., Hyogo (JP); Sabic Innovative Plastics IP B.V., Bergen op Zoom (NL)

( * ) Notice: Subject to any disclaimer, the term of this patent is extended or adjusted under 35 U.S.C. 154(b) by 351 days.

(21) Appl. No.: 12/670,045

(22) PCT Filed: Jul. 10, 2008

(86) PCT No.: PCT/JP2008/062452

§ 371 (c)(1),
(2), (4) Date: Jan. 21, 2010

(87) PCT Pub. No.: WO2009/014007

PCT Pub. Date: Jan. 29, 2009

(65) Prior Publication Data

US 2010/0205723 A1 Aug. 19, 2010

(30) Foreign Application Priority Data

Jul. 25, 2007 (JP) ..... 2007-193839
Sep. 26, 2007 (JP) ..... 2007-249722

(51) Int. Cl.
*D02G 3/36* (2006.01)

(52) U.S. Cl. ..... 57/210; 57/3

(58) Field of Classification Search ..... 57/3, 5, 57/10, 18, 210, 224, 252, 255
See application file for complete search history.

(56) References Cited

U.S. PATENT DOCUMENTS 4,922,701 A * 5/1990 Sawhney et al. ..... 57/12
4,958,485 A * 9/1990 Montgomery et al. ..... 57/210
7,155,891 B2 * 1/2007 Bader ..... 57/210
2005/0032449 A1 2/2005 Lovasic et al.

(Continued)

FOREIGN PATENT DOCUMENTS

JP 4-263646 A 9/1992

(Continued)

*Primary Examiner* — Shaun R Hurley
(74) *Attorney, Agent, or Firm* — Hamre, Schumann, Mueller & Larson, P.C.

(57) ABSTRACT

The multilayer-structured spun yarn of the present invention is a multilayer-structured spun yarn C composed of a core fiber A and a cover fiber B that wraps around the core fiber; the core fiber A is in a range of 20 to 50 wt %; the cover fiber B is in a range of 50 to 80 wt %; the core fiber A contains a para-aramid fiber and is a stretch breaking twist yarn; the cover fiber B contains a flame-retardant acrylic fiber, a polyetherimide fiber, or a meta-aramid fiber; the direction of twist of the stretch breaking yarn and the direction of twist of the multilayer-structured yarn are the same; and the multilayer-structured yarn C has a twist number 1.2 to 1.6 times greater than that of the stretch breaking yarn. The heat-resistant textile of the present invention uses the aforementioned multilayer-structured spun yarn. The heat-resistant protective suit of the present invention uses the aforementioned heat-resistant textile.

18 Claims, 1 Drawing Sheet

U.S. PATENT DOCUMENTS

| | | | | |
|---|---|---|---|---|
| 2005/0055997 | A1* | 3/2005 | Bader | 57/224 |
| 2005/0204718 | A1* | 9/2005 | Zhu et al. | 57/255 |
| 2008/0085411 | A1* | 4/2008 | Prickett | 428/365 |

FOREIGN PATENT DOCUMENTS

| | | | |
|---|---|---|---|
| JP | 9-078379 | A | 3/1997 |
| JP | 11-189940 | A | 7/1999 |
| JP | 2000-303285 | A | 10/2000 |
| JP | 2000-328384 | A | 11/2000 |
| JP | 2004-197259 | A | 7/2004 |
| JP | 2006-161179 | A | 6/2006 |
| JP | 2007-077537 | A | 3/2007 |
| KR | 10-0689887 | B1 | 2/2007 |

* cited by examiner

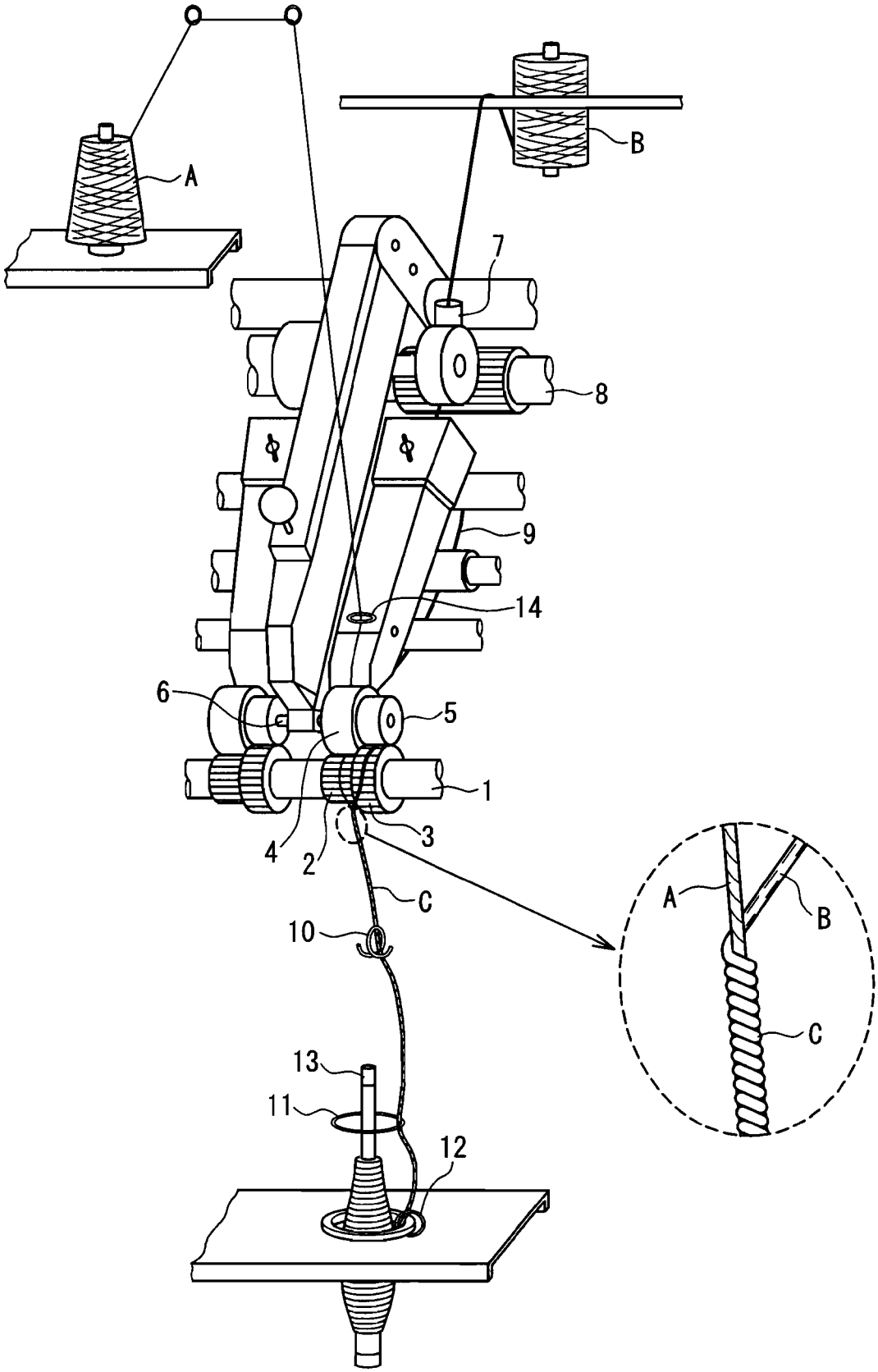
A
B
7
8
9
14
6
5
1
4
2
3
C
10
13
11
12
A
B
C

MULTILAYER STRUCTURED SPUN YARN, PROCESS FOR PRODUCING THE SAME, AND, FABRICATED FROM THE YARN, HEAT-RESISTANT FABRIC AND HEAT-RESISTANT PROTECTIVE SUIT

TECHNICAL FIELD

The present invention relates to a multilayer structured spun yarn, a method for producing the yarn, and a heat-resistant textile and a heat-resistant protective suit that use the yarn.

BACKGROUND ART

Strength and heat resistance are required in heat-resistant protective suits such as fire-fighting clothing and clothing used in disaster relief, and usually para-aramid fibers are used therefor. However, para-aramid fibers are problematic in that they have poor light resistance and undergo photodegradation when exposed to sunlight, exhibiting an immediate loss of strength and suffering discoloration. Therefore, blending with a meta-aramid fiber or the like has been proposed for securing light resistance (Patent Document 1).

However, even when a para-aramid fiber and a meta-aramid fiber are blended as proposed in Patent Document 1, the problems that the para-aramid fiber present on the surface undergoes photodegradation when exposed to sunlight, immediately loses strength, and experiences discoloration still remain. In the case of a blended yarn in particular, since respective fibers that constitute the spun yarn are moved outward and inward within the yarn due to the phenomenon called migration, degradation that has occurred in exposed portions results in deterioration in the strength of the entire yarn. Moreover, an ordinary multilayer-structured spun yarn is also problematic in that the core fiber and the cover fiber separate and a high-tenacity yarn is not likely to be obtained.

Patent Document 1: JP 2007-077537A

DISCLOSURE OF INVENTION

The present invention, in order to address the aforementioned problems of the conventional art, provides a multilayer-structured spun yarn that prevents the photodegradation of a para-aramid fiber in which the integrity between the core fiber and the cover fiber is high, that has good dye affinity, and that is inexpensive; a production method therefor; and a heat-resistant textile and a heat-resistant protective suit that use the yarn.

The multilayer-structured spun yarn of the present invention is a multilayer-structured spun yarn composed of a core fiber and a cover fiber that wraps around the core fiber; the core fiber is in a range of 20 to 50 wt %; the cover fiber is in a range of 50 to 80 wt %; the core fiber contains a para-aramid fiber and is a stretch breaking twist yarn; the cover fiber contains a flame-retardant acrylic fiber, a polyetherimide fiber, or a meta-aramid fiber; the direction of twist of the stretch breaking yarn and the direction of twist of the multilayer-structured yarn are the same; and the multilayer-structured yarn has a twist number 1.2 to 1.6 times greater than the twist number of the stretch breaking yarn.

The method for producing a multilayer-structured spun yarn of the present invention is a method for producing a multilayer structured spun yarn composed of a core fiber and a cover fiber that wraps around the core fiber; the core fiber is in a range of 20 to 50 wt %; the cover fiber is in a range of 50 to 80 wt %; a stretch breaking twist yarn containing a para-aramid fiber for use as the core fiber is supplied to front nip rollers of a ring spinning frame; the cover fiber is supplied from a drafting zone of the ring spinning frame; the cover fiber is fed at a rate 5 to 9% faster than the rate of the stretch breaking yarn for the core fiber for intertwining using the ring spinning frame that has front nip rollers with different diameters, and in this instance the direction of twist of the multilayer-structured yarn is arranged to be the same as the direction of twist of the stretch breaking yarn; and the multilayer-structured yarn has a twist number 1.2 to 1.6 times greater that the twist number of the stretch breaking yarn.

The heat-resistant textile of the present invention uses the aforementioned multilayer structured spun yarn.

Moreover, the heat-resistant protective suit of the present invention uses the aforementioned heat-resistant textile.

BRIEF DESCRIPTION OF DRAWINGS

FIG. 1 is a perspective illustration showing the principal part of the ring spinning frame in one example of the present invention.

DESCRIPTION OF REFERENCE NUMERALS

1: Front bottom roller, 2: Large diameter Small-diameter cylindrical member, 3: Large-diameter cylindrical member, 4 and 5: Front top rollers, 6: Arbor, 7: Trumpet feeder, 8: Back roller, 9: Drafting apron, 10: Snail wire, 11: Anti-node ring, 12: Traveler, 13: Spindle, 14: Yarn guide, A: Short-fiber bundle (stretch breaking para-aramid fiber bundle for the core fiber), B: Short-fiber bundle (fiber bundle for the cover fiber), C: Core-in-sheath plied spun yarn

BEST MODE FOR CARRYING OUT THE INVENTION

Since the present invention is a multilayer-structured spun yarn in which the core fiber is a twist yarn of a stretch breaking para-aramid fiber, the direction of twist of the stretch breaking yarn and the direction of twist of the multilayer-structured yarn are the same, and the cover fiber contains a flame-retardant acrylic fiber, a polyetherimide fiber, or a meta-aramid fiber, the present invention can attain a multilayer-structured spun yarn that prevents the photodegradation of the para-aramid fiber, in which the integrity between the core fiber and the cover fiber is high, that has good dye affinity, and that is inexpensive, and a heat-resistant textile and a heat-resistant protective suit that use the yarn. That is, in addition to the high tenacity of the para-aramid fiber itself that is used for the core fiber, by taking advantage of the tenacity of a stretch breaking yarn and by arranging the direction of twist of the multilayer-structured yarn to be the same as the direction of twist of the stretch breaking yarn, the integrity between the core fiber and the cover fiber is enhanced, thereby synergistically giving a yarn of high tenacity. Moreover, since the cover fiber of the multilayer-structured spun yarn contains a flame-retardant acrylic fiber, a polyetherimide fiber, or a meta-aramid fiber, the multilayer-structured spun yarn prevents the photodegradation of the para-aramid fiber, has good dye affinity, and is inexpensive.

(1) Core Fiber

In the present invention, a para-aramid fiber is used for the core fiber because a para-aramid fiber has a high tensile strength (for example, "Technora" manufactured by Teijin, Ltd.: 24.7 cN/decitex; "Kevlar" manufactured by DuPont: 20.3 to 24.7 cN/decitex), a high pyrolysis onset temperature (about 500° C. in both of the products mentioned above), and a limiting oxygen index (LOI) of 25 to 29, and thus is suitable for a heat-resistant textile and a heat-resistant protective suit. The single-fiber fineness of the para-aramid fiber is preferably in a range of 1 to 6 decitex, and more preferably in a range of 2 to 5 decitex.

A stretch breaking yarn of a para-aramid fiber is used for the core fiber. Here, the stretch breaking yarn refers to a spun yarn made by cutting a long-fiber bundle (tow) by drafting (pulling apart), and twining the fibers. A direct spinning method in which drafting and twining are carried out with one spinner may be used, or a spun yarn may be made through two or more steps where a sliver is formed and then twisting is applied (a perlok system or a converter method). A direct spinning method is preferable. Use of a stretch breaking yarn can maintain the tenacity at a high level and provide a multilayer-structured spun yarn in which excellent integrity with the cover fiber is achieved.

The preferable fineness of the stretch breaking yarn (single yarn) is preferably in a range of 200 to 55.6 decitex (a metric count of 50 to 180), more preferably in a range of 167 to 66.7 decitex (a metric count of 60 to 150). When the fineness is within the aforementioned ranges, the stretch breaking yarn has a high tenacity and is suitable also in terms of for example, texture for a heat-resistant protective suit or the like. Furthermore, the twist number is preferably 350 to 550 times/m for a single yarn having a metric count of 125, and more preferably 400 to 500 times/m. When the twist number is within the aforementioned ranges, the integrity with the cover fiber is enhanced further. In addition, a preferable fiber length is distributed in a range of 30 to 220 mm, and the average fiber length is in a range of 80-120 mm, and preferably 90-110 mm. Satisfying these ranges can maintain the tenacity at a higher level.

Next, the twist multiplier according to the present invention is described. The twist multiplier K is determined using the formula "twist number/m=K×√ metric count". The twist multiplier determined with this formula using the twist number of the aforementioned stretch breaking yarn for the core fiber, i.e., 350 to 550 times/m for a single yarn having a metric count of 125, is a twist multiplier K in a range of 30 to 50. Once a twist multiplier is determined, a uniform twist angle is attained even when yarns of different thicknesses (yarn count) are used.

(2) Cover Fiber

The cover fiber contains a flame-retardant acrylic fiber, a polyetherimide fiber, a meta-aramid fiber, or a mixture of these. Since these fibers are highly flame retardant and highly light resistant, they are advantageously used for the cover fiber. Examples of the meta-aramid fiber include "Conex" manufactured by Teijin, Ltd. (limiting oxygen index (LOI): 30) and "Nomex" manufactured by DuPont (limiting oxygen index (LOI): 30), and they have a tensile strength of about 4 to 7 cN/decitex. Examples of the flame-retardant acrylic fiber include a modacrylic fiber "Protex M" manufactured by Kaneka Corporation (limiting oxygen index (LOI): 32), trade name "Rufnen" manufactured by former Kanebo Corporation/Marutake Co. Ltd., and the like. These fibers have a tensile strength of about 2 to 3 cN/decitex. An example of the polyetherimide fiber is "Ultem" manufactured by Sabic Innovative Plastics (limiting oxygen index (LOI): 32). This fiber has a tensile strength of about 3 cN/decitex.

One preferable example of the cover fiber contains 10 to 100 wt % of at least one fiber selected from a flame-retardant acrylic fiber and a polyetherimide fiber. Since a flame-retardant acrylic fiber and a polyetherimide fiber have good dye affinity, they will not cause any problem even when used at 100 wt %. In another example, a meta-aramid fiber preferably is used at 0 to 90 wt %. More preferably, at least one fiber selected from a flame-retardant acrylic fiber and a polyetherimide fiber is used at 30 to 85 wt % and a meta-aramid fiber is used at 15 to 70 wt %; and particularly preferably, at least one fiber selected from a flame-retardant acrylic fiber and a polyetherimide fiber is used at 40 wt % to 60 wt % and a meta-aramid fiber is used at 40 wt % to 60 wt %. Satisfying the aforementioned ranges can further enhance tenacity, flame resistance, and light resistance.

The cover fiber is preferably bias cut. To "bias cut" means to cut a long-fiber bundle (tow) diagonally. A preferable fiber length is in a range of 50 to 180 mm, more preferably 60 to 150 mm, and particularly preferably 70 to 125 mm. Satisfying these ranges can maintain the tenacity at a higher level. Moreover, the single fiber fineness is preferably in a range of 1 to 6 decitex, and more preferably 2 to 5 decitex.

It is preferable that an antistatic fiber further is blended in the cover fiber. This is to inhibit the charging of the cover fiber when the final product is in use. Examples of the antistatic fiber include a metal fiber, a carbon fiber, a fiber in which metallic particles and carbon particles are mixed, and like fibers. The antistatic fiber preferably is added in a range of 0.1 to 1 wt % relative to the multilayer-structured spun yarn, and more preferably in a range of 0.3 to 0.7 wt %.

In addition, wool, flame-retardant rayon, flame-retardant cotton, or the like also can be blended in the cover fiber in any suitable proportion.

(3) Multilayer-Structured Spun Yarn

A ring spinning frame is used to form the multilayer-structured spun yarn. In this instance, the direction of twist of the multilayer-structured yarn is arranged to be the same as the direction of twist of the stretch breaking yarn for the core fiber. For example, if the stretch breaking yarn for the core fiber is twisted in the Z direction, twist in the Z direction is applied to the multilayer-structured yarn. It is thereby possible to increase the integrity between the core fiber and the cover fiber and enhance the tenacity of the multilayer-structured yarn. The twist number of the multilayer-structured yarn is 1.2 to 1.6 times greater than the twist number of the stretch breaking yarn, and preferably 1.3 to 1.5 times greater. Satisfying the aforementioned twist numbers can enhance the tenacity of the multilayer-structured yarn further.

It is preferable in the multilayer-structured yarn of the present invention that the core fiber is in a range of 20 to 50 wt % and the cover fiber is in a range of 50 to 80 wt %. More preferably, the core fiber is in a range of 25 to 40 wt % and the cover fiber is in a range of 60 to 75 wt %. Satisfying the aforementioned ranges can maintain the tenacity at a higher level, enhance coverage, and maintain light resistance at a high level.

(4) Device and Method for Producing Multilayer-Structured Spun Yarn

Next, the device and method for producing the multilayer structured yarn of the present invention is described.

FIG. 1 is a perspective illustration showing the principal part of the ring spinning frame in one example of the present invention. A pair of large and small cylindrical members 2 and 3 having two different diameters are provided per spindle on a front bottom roller 1 that actively revolves. The pair of cylindrical members 2 and 3 are connected directly and coaxially in the axial directions. A pair of cylindrical front top rollers 4 and 5 having different diameters are mounted on the pair of cylindrical members 2 and 3. The difference in diameter between the pair of front top rollers 4 and 5 is substantially the same as the difference in diameter between the pair of cylindrical members 2 and 3 located below, while the size relationship therebetween is the opposite to that between the pair of cylindrical members 2 and 3 located below. The pair of front top rollers 4 and 5 are covered with rubber cots, and are each externally fitted independently and rotatably to a weighed common arbor 6. A short-fiber bundle B drawn from a fiber bundle bobbin B is supplied to a back roller 8 from a guide bar via a trumpet feeder 7.

The short-fiber bundle A is a stretch breaking para-aramid fiber bundle for the core fiber, and the short-fiber bundle B is a fiber bundle for the cover fiber. Although not shown in the FIGURE, the trumpet feeder 7 can be slid in the axial directions of the front bottom roller 1, and the distance of its slide is adjustable. The short-fiber bundle B that has been forwarded from the back roller 8 and that has traveled through a drafting apron 9 is held and spun by the large-diameter cylindrical member 3 and the small-diameter cylindrical front top roller 5. The short-fiber bundle A is supplied via a yarn guide 14 to the large-diameter cylindrical front top roller 4 and the small-diameter cylindrical member 2 and spun.

Since the discharge rate of a short-fiber bundle B spun at and discharged from the large-diameter cylindrical member 3 is higher than the spinning rate of a short-fiber bundle A spun at and discharged from the small-diameter cylindrical member 2, when the two spun short-fiber bundles A and B are intertwined via a snail wire 10, the short-fiber bundle B is wound around the short-fiber bundle A, thereby forming a core-in-sheath multilayer-structured spun yarn C in which the short-fiber bundle A serves as a core and the short-fiber bundle B serves as a sheath.

The extent of overfeeding of the short-fiber bundle B relative to the short-fiber bundle A is preferably 5 to 9%, and more preferably 6 to 8%. When the extent of overfeeding is within the aforementioned ranges, the short-fiber bundle B wraps around the short-fiber bundle A in a "paper string"-like manner, thereby enabling the core fiber to be covered at a coverage of about 100%.

The spun yarn C thus formed is rolled around a spool 13 on a spindle via an anti-node ring 11 and a traveler 12. Even if the positions where the short-fiber bundles A and B are held on the cylindrical members 2 and 3 vary slightly in relation to respective spindles, since the ratio between the discharge rates of both yarns is always the same, there is no possibility that the produced core-in-sheath plied spun yarns C have varied qualities from spindle to spindle. When the trumpet feeder 7 is slid within the possible extent in the axial directions of the front bottom roller 1, the frictional area where the rubber-cot cover of the front top roller 5 and the short-fiber bundle B meet is broadened, and it is possible to prevent premature wear on the rubber-cot cover. Although not shown in the FIGURE, it is desirable that the yarn guide 14 is slid in the axial directions of the front bottom roller 1 to reduce wear on the rubber-cot cover of the cylindrical front top roller 4.

(5) Applications

The multilayer-structured spun yarn of the present invention may be used singly or after intertwining several yarns. Such yarns are used as a warp and a weft to create a woven fabric.

Examples of the heat-resistant textile that use the multilayer-structured spun yarn of the present invention include woven and knitted fabrics. The cloth construction employed in the woven fabrics may be a plain weave, a twill weave, a satin weave, or any such cloth construction. A preferable unit weight in the case of a woven fabric is in a range of 160 to 300 g/cm$^2$, and more preferably in a range of 180 to 250 g/cm$^2$. Work clothes also can be produced from such a woven fabric using a conventional sewing apparatus. The heat-resistant protective suit that use the heat-resistant textile includes fire-fighting clothing, a heat-resistant protective suit such as those used in disaster relief, security staff clothing, combat uniforms and work clothes used by, for example, the military, work clothes for furnace workers, etc.

EXAMPLES

The present invention will be described below in further detail by way of examples. The measurement method used in the examples and comparative examples of the present invention are as follows.

(1) Combustion Test

The char length created when a flame of a Bunsen burner was brought into contact for 12 seconds with the lower end of a woven fabric sample placed vertically, the afterflame time after the flame was removed, and the afterglow time were measured according to the method specified in JIS L1091A-4.

(2) Electrification Voltage Test

The voltage immediately after electrification and the half life were measured according to the method for a frictional electrification attenuation measurement specified in JIS L1094 5.4.

Example 1

1. Core Fiber

A stretch breaking yarn composed of a black spun-dyed product of a para-aramid fiber "Technora" manufactured by Teijin, Ltd., having a single-fiber fineness of 1.7 decitex (1.5 deniers), a fiber length of 37 to 195 mm (average fiber length: 106 mm), a metric count of 125 (single yarn), and a Z twist of 450 T/m (T: twist number, twist multiplier K: 90) was used. This stretch breaking yarn used was a product manufactured by Schappe of France.

2. Cover Fiber (1) A meta-aramid fiber used was a bias-cut product of "Conex" manufactured by Teijin, Ltd., having a single fiber fineness of 2.2 decitex (2 deniers) and a fiber length of 76 to 102 mm (average fiber length: 89 mm).

(2) A flame-retardant acrylic fiber used was a bias-cut product of a modacrylic fiber "Protex M" manufactured by Kaneka Corporation having a single-fiber fineness of 3.3 decitex (3 deniers) and a fiber length of 82 to 120 mm (average fiber length: 101 mm).

(3) A polyetherimide fiber used was a bias-cut product of "Ultem" manufactured by Sabic Innovative Plastics having a single-fiber fineness of 3.3 decitex (3 deniers) and a fiber length of 76 to 102 mm (average fiber length: 89 mm).

(4) As an antistatic fiber, "Beltron" manufactured by KB Seiren Ltd., having a single-fiber fineness of 5.5 decitex (5 deniers) and an average fiber length of 89 mm was used.

The proportion of each fiber blended was as presented in Table 1.

3. Device and Method for Producing Multilayer-Structured Spun Yarn

A spun yarn was prepared using the ring spinning frame shown in FIG. 1. The extent of overfeeding of the cover fiber bundle relative to the core fiber bundle was 7%. The direction of twist and the twist number were the Z direction and 630 T/m, respectively. The spun yarn thus obtained had a metric count of 32. The results obtained with the aforementioned conditions are presented in Table 1.

TABLE 1

| Experiment No. | Core fiber (proportion for blending: wt %) | Cover fiber (proportion for blending: wt %) | Yarn count of single yarn (metric count) | Breaking tenacity (N) | Coverage (visual inspection) |
|---|---|---|---|---|---|
| A1 | Para-aramid fiber (25.6) | Meta-aramid fiber (40)<br>Flame-retardant acrylic fiber (34)<br>Antistatic fiber (0.4) | 32 | 981 | Acceptable |
| A2 | Para-aramid fiber (20) | Meta-aramid fiber (40)<br>Flame-retardant acrylic fiber (40) | 25 | 971 | Acceptable |
| A3 | Para-aramid fiber (30) | Meta-aramid fiber (35)<br>Flame-retardant acrylic fiber (35) | 37.5 | 877 | Acceptable |
| A4 | Para-aramid fiber (25.6) | Meta-aramid fiber (59)<br>Flame-retardant acrylic fiber (15)<br>Antistatic fiber (0.4) | 32 | 1156 | Acceptable |
| A5 | Para-aramid fiber (25.6) | Meta-aramid fiber (7)<br>Flame-retardant acrylic fiber (67)<br>Antistatic fiber (0.4) | 32 | 833 | Acceptable |
| A6 | Para-aramid fiber (25.6) | Meta-aramid fiber (40)<br>Polyetherimide fiber (34)<br>Antistatic fiber (0.4) | 32 | 999 | Acceptable |
| A7 | Para-aramid fiber (25.6) | Polyetherimide fiber (74)<br>Antistatic fiber (0.4) | 32 | 983 | Acceptable |

Coverage (visually inspected) was determined according to observation of the surface of a multilayer-structured spun yarn and if the black color of the core fiber was not observable, the multilayer-structured spun yarn was regarded as acceptable, and if observable, then unacceptable. It is empirically understood that if no core fiber is observable in the visual inspection, the light resistance is good. Accordingly, the multilayer-structured spun yarns of Experiment Nos. A1 to A7 had a high breaking tenacity and excellent coverage.

Example 2

The multilayer-structured spun yarn obtained in Experiment No. A1 of Example 1 was processed into a two-fold yarn, and in this instance a twist of 600 T/m was applied in the twist direction of S (yarn count/twist number: 2/32). Using this two-fold yarn, a plain-woven fabric having a warp density of 196 yarns/10 cm, a weft density of 164 yarns/10 cm, and a unit weight of 229.5 g/m$^2$ was obtained.

The physical properties of the woven fabric thus obtained were as follows.

(1) Char length according to the JIS L1091A-4 method (1992, flame contact: 12 seconds, vertical method), longitudinal: 2.9 cm, horizontal: 3.7 cm; afterflame time, longitudinal: 0.0 sec, horizontal: 0.0 sec; afterglow time, longitudinal: 1.5 sec, horizontal: 1.3 sec (2) Voltage according to JIS L1094 5.4 (frictional electrification attenuation measurement method) immediately after, longitudinal: −310 V, horizontal: −380 V; half life, longitudinal: 12.5 seconds, horizontal: 13.8 seconds (3) Tensile strength according to the JIS 1096A method (raveled strip method), longitudinal: 1960 N, horizontal: 1940 N; tensile elongation, longitudinal: 15.1%, horizontal: 7.8%

(4) Tear strength according to the JIS 1096A-2 method, longitudinal: 173.5 N, horizontal: 169.5 N (5) Dyeing test A jet dyeing machine manufactured by Nissen Corporation was used as a dyeing machine, and dyes and other additives (Nichilon Golden Yellow GL (Nissei kasei Co., Ltd.) 1 o.w.f. (o.w.f. stands for "on the weight of fiber"), NICHILON Red GRL (Nissei kasei Co., Ltd.) 0.02% o.w.f., Aizen Cathilon Navy Blue FRL 200% (Hodogaya Chemical Co., Ltd.) 0.13 o.w.f., and anhydrous sodium sulfate 3 o.w.f.) were added, and dyeing treatment was carried out at 102° C. for 30 minutes.

The colorfastness was as follows. The colorfastness against perspiration (acid) (alkali) according to JIS L 0848 was grade 5 for both color change and fabric contamination. The colorfastness against friction according to JIS L 0849 was grade 4 to 5 (dry) and grade 4 (wet). The colorfastness against light according to JIS L 0842 was grade 5 for both 40-hour and 80-hour tests.

(6) Washing test

The dimensional change after a washing test according to ISO 6330 2A-E performed 5 times was −1.0% in a longitudinal direction and −1.5% in a horizontal direction, and the appearance was given grade 5 (no change in appearance).

Comparative Example 1

A multilayer-structured spun yarn was obtained using the same conditions as in Experiment No. 1 of Example 1 except that the direction of twist was S and the twist number was 1080 T/m (T: twist number) when producing the multilayer-structured spun yarn. The breaking tenacity of the multilayer-structured spun yarn thus obtained was 758 (N), and was inferior to the spun yarn of Example 1. The coverage was unacceptable.

Comparative Example 2

The same conditions as in Experiment No. 1 of Example 1 were employed in producing a multilayer-structured spun yarn except that a spun yarn composed of a black spun-dyed product having a metric count of 125 (single yarn) and a Z twist of 450 T/m (T: twist number) obtained by a worsted process and a ring spinning frame using a staple fiber of a bias-cut product having a fiber length of 76 to 102 mm (average fiber length: 89 mm) was used in place of the stretch breaking yarn. The breaking tenacity of the multilayer-structured spun yarn thus obtained was 725 (N), and was inferior to the spun yarn of Example 1. The coverage was acceptable.

Example 3

1. Core Fiber

A stretch breaking yarn composed of a black spun-dyed product of a para-aramid fiber "Technora" manufactured by Teijin, Ltd., having a single-fiber fineness of 1.7 decitex (1.5 deniers), a fiber length of 37 to 195 mm (average fiber length:

106 mm), a metric count of 125 (single yarn), and a Z twist of 450 T/m (T: twist number, twist multiplier K: 90) was used. This stretch breaking yarn used was a product manufactured by Schappe of France.

2. Cover Fiber (1) A meta-aramid fiber used was a bias-cut product of "Conex" manufactured by Teijin, Ltd., having a single fiber fineness of 2.2 decitex (2 deniers) and a fiber length of 76 to 102 mm (average fiber length: 89 mm).

(2) A polyetherimide fiber used was a bias-cut product of "Ultem" manufactured by Sabic Innovative Plastics having a single-fiber fineness of 3.3 decitex (3 deniers) and a fiber length of 76 to 102 mm (average fiber length: 89 mm).

(3) As an antistatic fiber, "Beltron" manufactured by KB Seiren Ltd., having a single-fiber fineness of 5.5 decitex (5 deniers) and an average fiber length of 89 mm was used.

The proportion of each fiber blended is as presented in Table 2.

3. Device and Method for Producing Multilayer-Structured Spun Yarn

A spun yarn was prepared using the ring spinning frame shown in FIG. 1. The extent of overfeeding of the cover fiber bundle relative to the core fiber bundle was 7%. The direction of twist and the twist number were the Z direction and 630 T/m (1.4 times greater than the twist number of the stretch breaking yarn), respectively. The results obtained with the aforementioned conditions are presented in Table 2.

TABLE 2

| Experiment No. | Core fiber (proportion for blending: wt %) | Cover fiber (proportion for blending: wt %) | Yarn count of single yarn (metric count) | Breaking tenacity (N) | Coverage (visual inspection) |
|---|---|---|---|---|---|
| B1 | Para-aramid fiber (20) | Meta-aramid fiber (59.6)<br>Polyetherimide fiber (20)<br>Antistatic fiber (0.4) | 25 | 1209 | Acceptable |
| B2 | Para-aramid fiber (25.6) | Meta-aramid fiber (54.4)<br>Polyetherimide fiber (20) | 32 | 1032 | Acceptable |
| B3 | Para-aramid fiber (25.6) | Meta-aramid fiber (54)<br>Polyetherimide fiber (20)<br>Antistatic fiber (0.4) | 32 | 1019 | Acceptable |
| B4 | Para-aramid fiber (35.6) | Meta-aramid fiber (64)<br>Polyetherimide fiber (20)<br>Antistatic fiber (0.4) | 45 | 819 | Acceptable |
| B5 | Para-aramid fiber (48) | Meta-aramid fiber (51.6)<br>Polyetherimide fiber (20)<br>Antistatic fiber (0.4) | 60 | 797 | Acceptable |
| B6 (Comp. Ex.) | Para-aramid fiber (15.6) | Meta-aramid fiber (64.0)<br>Polyetherimide fiber (20)<br>Antistatic fiber (0.4) | 20 | 1543 | Acceptable |
| B7 (Comp. Ex.) | Para-aramid fiber (55.6) | Meta-aramid fiber (24)<br>Polyetherimide fiber (20)<br>Antistatic fiber (0.4) | 70 | 659 | Not acceptable |

Coverage (visually inspected) was determined according to observation of the surface of a multilayer-structured spun yarn and if the black color of the core fiber was not observable, the multilayer-structured spun yarn was regarded as acceptable, and if observable, then unacceptable.

Accordingly, the multilayer-structured spun yarns of Experiment Nos. B1 to B5 had a high breaking tenacity and excellent coverage. In contrast, in Experiment No. B6, the core fiber contained little para-aramid, and the multilayer-structured spun yarn had a poor breaking tenacity despite its large yarn count and was not preferable. Moreover, in Experiment No. B7, the proportion of the cover fiber was small and the coverage was not acceptable.

Example 4

The core fiber was of a para-aramid fiber (extent of blending: 25.6 wt %), and the cover fiber was of a meta-aramid fiber (extent of blending: 54.0 wt %), a polyetherimide fiber (20 wt %) and an antistatic fiber (extent of blending: 0.4 wt %). A stretch breaking yarn composed of a black spun-dyed product of a para-aramid fiber "Technora" manufactured by Teijin, Ltd., having a single-fiber fineness of 1.7 decitex (1.5 deniers), a fiber length of 37 to 195 mm (average fiber length: 106 mm), and a metric count of 125 (single yarn) (twist multiplier K is presented in Table 3) was used as the core fiber. The cover fiber was a blend of a bias-cut product of a meta-aramid fiber "Conex" manufactured by Teijin, Ltd., having a single fiber fineness of 2.2 decitex (2 deniers) and a fiber length of 76 to 102 mm (average fiber length: 89 mm), a bias-cut product of a polyetherimide fiber "Ultem" manufactured by Sabic Innovative Plastics having a single-fiber fineness of 3.3 decitex (3 deniers) and a fiber length of 76 to 102 mm (average fiber length: 89 mm), and an antistatic fiber "Beltron" manufactured by KB Seiren Ltd., having a single-fiber fineness of 5.5 decitex (5 deniers) and an average fiber length of 89 mm.

A spun yarn was prepared using the ring spinning frame shown in FIG. 1. The extent of overfeeding of the cover fiber bundle relative to the core fiber bundle was 7%. The direction of twist was the same as that of the stretch breaking yarn and the twist number was as presented in Table 3. The spun yarn thus obtained had a metric count of 32. The results obtained with the aforementioned conditions are presented in Table 3.

TABLE 3

| Experiment No. | Core fiber (stretch breaking yarn) Direction of twist | Twist number A (T/m) | Twist multiplier K | Two-layered spun yarn Direction of twist | Twist number B (T/m) | B/A | Breaking tenacity (N) | Coverage (visual inspection) |
|---|---|---|---|---|---|---|---|---|
| C1 | Z | 450 | 40 | Z | 630 | 1.4 | 1019 | Acceptable |
| C2 (Comp. Ex.) | Z | 450 | 40 | Z | 490 | 1.1 | 782 | Not acceptable |
| C3 | Z | 450 | 40 | Z | 540 | 1.2 | 833 | Acceptable |
| C4 | Z | 450 | 40 | Z | 580 | 1.3 | 895 | Acceptable |
| C5 | Z | 450 | 40 | Z | 670 | 1.5 | 924 | Acceptable |
| C6 | Z | 450 | 40 | Z | 720 | 1.6 | 856 | Acceptable |
| C7 (Comp. Ex.) | Z | 450 | 40 | Z | 770 | 1.7 | 820 | Acceptable |

Accordingly, the multilayer-structured spun yarns of Experiment Nos. C1, C3 to C6 had a high breaking tenacity and excellent coverage. In contrast, the multilayer-structured spun yarn of Experimental No. C2 (comparative example) had a poor breaking tenacity since the value of the twist number B/A was lower than the range of the present invention, and the coverage was unacceptable. In addition, the multilayer-structured spun yarn of Experimental No. C7 (comparative example) also had a poor breaking tenacity since the value of the twist number B/A was higher than the range of the present invention.

Example 5

The multilayer-structured spun yarn obtained in Experiment No. B3 of Example 3 was processed into a two-fold yarn, and in this instance a twist of 600 T/m was applied in the twist direction of S (yarn count/twist number: 2/32). Using this two-fold yarn, a plain-woven fabric having a warp density of 196 yarns/10 cm, a weft density of 168 yarns/10 cm, and a unit weight of 234.4 g/m$^2$ was obtained.

The physical properties of the woven fabric thus obtained were as follows.

(1) Char length according to the JIS L 1091 A-4 method (1992, flame contact: 12 seconds, vertical method), longitudinal: 2.0 cm, horizontal: 2.0 cm; afterflame time, longitudinal: 0.0 sec, horizontal: 0.0 sec; afterglow time, longitudinal: 0.9 sec, horizontal: 0.8 sec (2) Voltage according to JIS L 1094 5.4 (frictional electrification attenuation measurement method), immediately after, longitudinal: −260V, horizontal: −250V; half life, longitudinal: 20 sec, horizontal: 13.9 sec (3) Tensile strength according to the JIS 1096A method (raveled strip method), longitudinal: 1980 N, horizontal: 1980 N; tensile elongation, longitudinal: 16.2%, horizontal: 8.4%

(4) Tear strength according to the JIS 1096A-2 method, longitudinal: 180.3 N, horizontal: 186.2 N (5) Washing test The dimensional change after a washing test according to ISO 6330 2A-E performed 5 times was −1.0% in a longitudinal direction and −1.5% in a horizontal direction, and the appearance was given grade 5 (no change in appearance).

Comparative Example 3

A multilayer-structured spun yarn was obtained using the same conditions as in Experiment No. B1 of Example 3 except that the direction of twist was S and the twist number was 1080 T/m when producing the multilayer-structured spun yarn. The breaking tenacity of the multilayer-structured spun yarn thus obtained was 758 (N), and was inferior to the spun yarn of Experiment No. B1 of Example 3. The coverage was unacceptable.

Example 6

The multilayer-structured spun yarn obtained in Experiment No. A7 of Example 1 was processed into a two-fold yarn, and in this instance a twist of 600 T/m was applied in the twist direction of S (yarn count/twist number: 2/32). Using this two-fold yarn, a plain-woven fabric having a warp density of 198 yarns/10 cm, a weft density of 166 yarns/10 cm, and a unit weight of 237 g/m$^2$ was obtained.

The physical properties of the woven fabric thus obtained were as follows.

(1) Char length according to the JIS L 1091A-4 method (1992, flame contact: 12 seconds, vertical method), longitudinal: 3.3 cm, horizontal: 3.7 cm, afterflame time, longitudinal: 0.0 sec, horizontal: 0.0 sec, afterglow time, longitudinal: 0.9 sec, horizontal: 0.8 sec (2) Voltage according to JIS L 1094 5.4 (frictional electrification attenuation measurement method) immediately after, longitudinal: −340V, horizontal: −390V; half life, longitudinal: 16.1 sec, horizontal: 16.5 sec (3) Tensile strength according to the JIS L1096A method (raveled strip method), longitudinal: 1790 N, horizontal: 1650 N; tensile elongation, longitudinal: 19.5%, horizontal: 11.5%

(4) Tear strength according to the JIS 1096A-2 method, longitudinal: 164 N, horizontal: 166 N (5) Dyeing test A jet dyeing machine manufactured by Nissen Corporation was used as a dyeing machine, and dyes and other additives (Kayaron Polyester Yellow FSL (Nippon Kayaku Co., Ltd.) 3.60% o.w.f., Kayaron Red SSL (Nippon Kayaku Co., Ltd.) 0.36% o.w.f., Kayaron Polyester Blue SSL (Nippon Kayaku Co., Ltd.) 1.24% o.w.f., acetic acid (68 wt %) 0.0036% o.w.f., and sodium acetate 0.0067% o.w.f.) were added, and dyeing treatment was carried out at 135° C. for 60 minutes. The colorfastness was as follows. The colorfastness against perspiration (acid) (alkali) according to JIS L 0848 was grade 5 for both color change and fabric contamination. The colorfastness against friction according to JIS L 0849 was grade 5 (dry) and grade 4 to 5 (wet). The colorfastness against light according to JIS L 0842 was grade 4 for both 40-hour and 80-hour tests.

(6) Washing test

The dimensional change after a washing test according to ISO 6330 2A-E performed 5 times was −1.0% in a longitudinal direction and −1.0% in a horizontal direction, the appearance was given grade 5 (no change in appearance).

The invention claimed is:

1. A multilayer-structured spun yarn comprising a core fiber and a cover fiber that wraps around the core fiber, the core fiber being in a range of 20 to 50 wt % and the cover fiber being in a range of 50 to 80 wt %, the core fiber comprising a para-aramid fiber and being a stretch breaking real-twist yarn, the cover fiber comprising a flame-retardant acrylic fiber, a polyetherimide fiber, or a meta-aramid fiber, the direction of twist of the stretch breaking yarn and the direction of twist of the multilayer-structured yarn being the same, the multilayer-structured yarn having a twist number 1.2 to 1.6 times greater than the twist number of the stretch breaking yarn.

2. The multilayer-structured spun yarn according to claim 1, wherein the core fiber has a twist multiplier expressed in metric count in a range of 30 to 50.

3. The multilayer-structured spun yarn according to claim 1, wherein the cover fiber comprises 10 to 100 wt % of at least one fiber selected from a flame-retardant acrylic fiber and a polyetherimide fiber.

4. The multilayer-structured spun yarn according to claim 1, wherein the cover fiber comprises 0 to 90 wt % of a meta-aramid fiber.

5. The multilayer-structured spun yarn according to claim 1, wherein a fiber of the cover fiber is bias cut.

6. The multilayer-structured spun yarn according to claim 1, wherein an antistatic fiber further is blended in a fiber of the cover fiber.

7. The multilayer-structured spun yarn according to claim 1, wherein the core fiber is a single yarn and has a fineness in metric count in a range of 50 to 180 (55.6 to 200 decitex).

8. The multilayer-structured spun yarn according to claim 1, wherein the core fiber has a fiber length distributed in a range of 30 to 220 mm and has an average fiber length in a range of 80 to 120 mm.

9. A heat-resistant textile that uses the multilayer-structured spun yarn according to claim 1.

10. A heat-resistant protective suit that uses the heat-resistant textile according to claim 9.

11. A method for producing a multilayer-structured spun yarn comprising a core fiber and a cover fiber that wraps around the core fiber, wherein the core fiber is in a range of 20 to 50 wt % and the cover fiber is in a range of 50 to 80 wt %, a stretch breaking real-twist yarn comprising a para-aramid fiber for use as the core fiber is supplied to front nip rollers of a ring spinning frame, the cover fiber is supplied from a drafting zone of the ring spinning frame, the cover fiber is fed at a rate 5 to 9% faster than the rate of the stretch breaking yarn for the core fiber for intertwining using the ring spinning frame that has front nip rollers with different diameters, and in this instance a direction of twist of the multilayer-structured yarn is arranged to be the same as a direction of twist of the stretch breaking yarn, and the multilayer-structured yarn has a twist number 1.2 to 1.6 times greater than a twist number of the stretch breaking yarn.

12. The method for producing a multilayer-structured spun yarn according to claim 11, wherein the core fiber has a twist multiplier expressed in metric count in a range of 30 to 50.

13. The method for producing a multilayer-structured spun yarn according to claim 11, wherein the cover fiber comprises 10 to 100 wt % of at least one fiber selected from a flame-retardant acrylic fiber and a polyetherimide fiber.

14. The method for producing a multilayer-structured spun yarn according to claim 11, wherein the cover fiber comprises 0 to 90 wt % of a meta-aramid fiber.

15. The method for producing a multilayer-structured spun yarn according to claim 11, wherein a fiber of the cover fiber is bias cut.

16. The method for producing a multilayer-structured spun yarn according to claim 11, wherein an antistatic fiber further is blended in a fiber of the cover fiber.

17. The method for producing a multilayer-structured spun yarn according to claim 11, wherein the core fiber is a single yarn and has a fineness in metric count in a range of 50 to 180, or 55.6 to 200 decitex.

18. The method for producing a multilayer-structured spun yarn according to claim 11, wherein the core fiber has a fiber length distributed in a range of 30 to 220 mm and has an average fiber length of 80 to 120 mm.

* * * * *